United States Patent [19]

Kiczek et al.

[11] 4,415,489

[45] Nov. 15, 1983

[54] PROCESS FOR MAKING HIGH SOLIDS CONTENT ZEOLITE A-ALKYLBENZENE SULFONATE COMPOSITIONS SUITABLE FOR USE IN MAKING SPRAY DRIED DETERGENT COMPOSITIONS

[75] Inventors: Alexander P. Kiczek, Middletown; Leo A. Salmen, North Bergen, both of N.J.; Clark B. Tower, Oxford, N.Y.

[73] Assignee: Colgate Palmolive Company, New York, N.Y.

[21] Appl. No.: 12,704

[22] Filed: Apr. 6, 1979

[51] Int. Cl.[3] ..... C11D 1/22; C11D 3/12; C11D 11/04; C11D 17/06

[52] U.S. Cl. ..... 252/558; 252/140; 252/174.25; 252/179; 252/539; 252/540; 252/559

[58] Field of Search ..... 252/136, 140, 174.25, 252/179, 539, 540, 558, 559

[56] References Cited

U.S. PATENT DOCUMENTS

| | | | |
|---|---|---|---|
| 3,755,180 | 8/1973 | Austin | 252/99 |
| 3,886,079 | 5/1975 | Burke | 252/109 |
| 3,985,669 | 10/1976 | Krummel | 252/116 |
| 4,000,094 | 12/1976 | Fleming | 252/557 |
| 4,072,622 | 2/1978 | Kuhling | 252/179 |
| 4,094,778 | 6/1978 | Denny | 210/38 A |
| 4,102,977 | 7/1978 | Sugahara | 423/118 |

FOREIGN PATENT DOCUMENTS

| | | | |
|---|---|---|---|
| 1464427 | 2/1977 | United Kingdom | 252/174.25 |
| 1494760 | 12/1977 | United Kingdom | 252/174.25 |
| 1498213 | 1/1978 | United Kingdom | 252/99 |
| 1525775 | 9/1978 | United Kingdom | 252/174.25 |

*Primary Examiner*—Dennis L. Albrecht

[57] ABSTRACT

A process for making a high solids content Zeolite A-alkylbenzene sulfonate detergent composition suitable for use in making spray dried detergent compositions includes manufacturing Zeolite A by a hydrogel, clay conversion, natural silica or equivalent process so that the Zeolite A is present in an aqueous medium containing alkali metal hydroxide in solution therein, separating a substantial proportion of the aqueous medium from the Zeolite A so as to produce Zeolite A particles, usually in cake form, containing excess alkali metal hydroxide solution on particle surfaces and occluded by such particles, and at least partially neutralizing said excess alkali metal hydroxide with a high concentration aqueous alkylbenzene sulfonic detergent acid, such as a sulfonic detergent acid resulting from oleum sulfonation or sulfur trioxide sulfonation of a linear higher alkylbenzene. Included within the invention and preferred are processes in which, when the alkali metal hydroxide solution of the particle surfaces is neutralized with the detergent sulfonic acid, a sufficient excess of such hydroxide is present so that the detergent acid is neutralized and enough hydroxide or alkaline neutralization products are left so that the product is of a pH in the range of 7 to 11. The neutralization reaction may be carried out step-wise and such is often preferable. Also, the products of such reactions may be spray dried directly for use as is or for addition to other detergent composition components or they may be crutched with other such components, e.g., inorganic builder and filler salts, and then spray dried. By utilizing the present method washing or "rinsing" of the zeolite may be avoided, crutcher moisture contents before spray drying may be kept desirably low and a product of excellent physical and washing properties, which does not objectionably deposit on washed materials, may be made and dried by an energy conserving process.

5 Claims, No Drawings

PROCESS FOR MAKING HIGH SOLIDS CONTENT ZEOLITE A-ALKYLBENZENE SULFONATE COMPOSITIONS SUITABLE FOR USE IN MAKING SPRAY DRIED DETERGENT COMPOSITIONS

This invention relates to processes for the manufacture of Zeolite A and detergent compositions containing such product. More specifically, it relates to utilization of an aqueous high concentration alkylbenzene sulfonic detergent acid for the neutralization of excess alkali metal hydroxide on Zeolite A particles that may result from any of the normal manufacturing processes for the production of Zeolite A so that a desirable mixture of Zeolite A and higher alkylbenzene sulfonate detergent is produced. The resulting mixture of Zeolite A and higher alkylbenzene sulfonate detergent may be spray dried, if desired, or more preferably, may be mixed with other detergent composition component materials in a crutcher and may be spray dried to produce a superior particulate detergent composition, which is free flowing, effective for heavy duty use in hard water and which does not objectionably deposit a powder coating of Zeolite A on materials washed with it.

The use of zeolites for softening hard water by "absorption" of hardness ions, such as calcium ions, from the water has been known for many years. In British patent specifications Nos. 1,473,201 and 1,473,202 there have been described detergent compositions containing certain zeolites, including Zeolite A, the purposes of the zeolite being to remove calcium ions from an aqueous washing medium and to act as a builder for a synthetic organic detergent component of the detergent composition. Various methods have been described in a multiplicity of patents, articles in the scientific literature and textbooks for the manufacture of "synthetic zeolites", hereinafter referred to as zeolites. Among the authoritative texts describing such methods is *Zeolite Molecular Sieves: Structure, Chemistry, and Use,* by Donald W. Breck, published in 1974 by John Wiley and Sons, Inc., in which the manufacture of such zeolites is described in the portion of Chapter 9 extending from page 725 through 741, and in references cited at pages 754 and 755. Such pages are incorporated herein by reference.

U.S. Pat. No. 2,882,243, which also describes manufacturing methods for the production of Zeolite A, mentions the adverse effect of addition of excess acid to Zeolite A. British patent specification No. 1,498,213, in Example 10 thereof, teaches the reaction of alkylbenzene sulfonic acid with a mixture of other detergent composition components, including an aluminum silicate suspension, in the presence of excess alkali, followed by spray drying of the aqueous mixture. U.S. Pat. No. 4,072,622 mentions the washing of an aluminosilicate suspension in aqueous alkaline medium and subsequent neutralization of the sodium hydroxide remaining with aqueous sulfuric acid or alkylbenzene sulfonic acid. German patent specification-disclosure No. 2,514,399 discloses the adjustment of the pH of a zeolitic molecular sieve, in an aqueous medium containing free alkali, by treatment with an acid, such as an inorganic acid, e.g., sulfuric acid, or an organic acid, such as a sulfonic acid which is also useful for the manufacture of surface active agents. In a listing of various surface active agents alkylbenzene sulfonates are mentioned. In Example 6 of such specification it is mentioned that a Zeolite A is separated from its mother liquor by means of a belt filter, the filter cake is washed with water which has been acidified with alkylbenzene sulfonic acid and the product is dried in a rotary dryer. British specification No. 1,464,427, in process 1*f*, at page 12 thereof, mentions the mixing of alkylbenzene sulfonic acid with an aluminum silicate suspension, followed by addition of other components of a desired final detergent product and spray drying.

Although the prior art known to applicants suggests the utilization of acid forms of synthetic organic detergents for addition to zeolitic aluminum silicate materials to neutralize alkaline materials present and also mentions subsequent manufacturing of the products thereof into detergent compositions by mixing with other detergent composition components and drying, none of the methods described in the prior art shows the present invention and its advantages and none makes it obvious. In accordance with the present invention there is provided a process for making a high solids content Zeolite A-alkylbenzene sulfonate composition, suitable for use in making spray dried detergent compositions, which comprises manufacturing Zeolite A in an aqueous medium containing alkali metal hydroxide in solution therein, separating a substantial proportion of the aqueous medium from the Zeolite A so as to produce Zeolite A particles containing excess alkali metal hydroxide solution on particle surfaces, and at least partially neutralizing said excess alkali metal hydroxide with a high concentration aqueous alkylbenzene sulfonic detergent acid. In preferred embodiments of the invention the alkylbenzene sulfonic acid concentration is above 85%, the alkylbenzene sulfonic acid is of a certain type, the ratio of such sulfonic acid to Zeolite A is within a described range, neutralization is to a pH within a mentioned range and the solids content of the Zeolite A cake is at least 30%. Also, it is preferred to make a substantial proportion, preferably all, of the linear higher alkylbenzene sulfonate detergent content of the intermediate mixture of such detergent with Zeolite A in the same mixing vessel in which the excess alkali metal hydroxide on the Zeolite A particles' surfaces is neutralized. Sometimes this may be effected by utilizing an excess (with respect to the hydroxide on the zeolite) of the sulfonic acid and additional sodium hydroxide, often preferably bringing these into reactive contact in a plurality of reaction steps. The "intermediate" product made, comprising Zeolite A, sulfonate detergent and a limited proportion of water, may be dried for subsequent use or may be mixed with other detergent composition components in the same or different manufacturing vessel and dried, preferably by spray drying, or it may be used "as is".

The particulate products of the processes of the present invention are free flowing and are effective as detergents, washing clothes effectively and without depositing objectionable quantities of aluminosilicate powder on the washed laundry. The method of manufacture employed results in lowered moisture contents for the crutcher mix to be spray dried, facilitating drying, conserving energy and producing the final detergent bead product in good physical form. It also avoids the need for prior washing and/or drying of the Zeolite A component and all or a substantial part of the anionic detergent component of the final detergent composition.

Although the present invention is applicable to the manufacture of other zeolites than Zeolite A and may be used for making similar or related synthetic or partially synthetic "selective absorbents" for hardness ions, it is primarily intended for the manufacture of Zeolite A, preferably in hydrated crystalline form, like that of Zeolite 4A. The product made will normally be of the formula $(Na_2O)_{0.9-1.1}.(Al_2O_3).(SiO_2)_{1.5-3}$, preferably being $(Na_2O)_{0.9-1.1}.(Al_2O_3).(SiO_2)_{1.9-2.1}$. Idealized, the formula is $Na_2O.Al_2O_3.(SiO_2)_2$. In crystalline form there may be present water of hydration to the extent of from about 5 to 27 mols thereof per mol of sodium aluminosilicate and preferably there will be from 20 to 27, e.g., 22 mols, of water present per mol of the aluminosilicate. While the amorphous product includes no water bound in a crystalline structure, water may be present with the amorphous material and may be "trapped" in the product. Both the crystalline and amorphous aluminosilicates have been found to be useful for "absorbing" normally interfering hardness ions, such as calcium ions, from hard water, preventing the precipitation of insoluble salts from said hardness ions and helping to build the action of synthetic organic detergents in heavy duty detergent compositions. To have such desirable effects it is preferred that the aluminosilicate produced should be capable of binding at least 25 milligrams and preferably 50 to 100 or more milligrams of calcium ion per gram of the aluminosilicate (excluding any water of hydration in determining the aluminosilicate weight). Desirably, the ultimate particle sizes of the Zeolite A made will be in the range of from 0.1 to 12 microns (including both amorphous and crystalline forms), preferably 1 to 10 microns (for the crystalline form) and will average (weight average) 3 to 7 microns. The "pore" sizes of preferred particles will be like those of Zeolite 4A (but may be about 13 Angstroms for Zeolite X, for example).

The present process is applicable to the neutralization of zeolites made by any of the manufacturing processes normally employed, which are well known in the art, such as those described at pages 725–740 of the Breck text previously mentioned. Preferably, the zeolite is manufactured by the reaction of sodium silicate, alumina trihydrate, caustic (50% sodium hydroxide) and water. After pre-mixing of the sodium silicate and sodium aluminate (made from caustic and alumina trihydrate) in an aqueous medium additional caustic is admixed therewith at about room temperature and an amorphous zeolite gel results. The amorphous form of the zeolite may be employed or the product may be heated, as is known in the art, to promote formation of the usually desired hydrated crystalline form.

After making of such product excess aqueous phase is removed from the zeolite particles by any suitable method, including settling, centrifuging, evaporating, filtering, absorption, chemical reaction, preferential hydration of another material, etc., or combinations thereof, but filtration is preferred. Such filtration may be effected by use of any suitable commercial filtration apparatus, such as plate and frame filters and filter presses but vacuum drum filters are preferred. Normally a substantial proportion, e.g., half or more, of the aqueous medium (largely water plus caustic) is removed so as to result in desired contents of zeolite and caustic in the remaining material, e.g., 50% solids (zeolite [anhydrous basis]+NaOH) and 50% water.

The filtered product, preferably in the form of a cake (although a thick, flowly flowable liquid or dilatant gel may sometimes also be useful), has excess sodium hydroxide (or other alkali metal hydroxide) on the surfaces of the "particles" thereof or occluded in the ticulate zeolite structure. Although in following the usual processes such cake would be washed free of the hydroxide with water, in the processes of this invention some or all of the excess hydroxide present in the filter cake is converted to a useful component or to a plurality of useful components of a detergent composition that may be produced from a synthetic detergent-zeolite-water mixture of this invention. Thus, it is a signifacant aspect of this invention that the normal washing step be omitted and it is also important that excess moisture in the reaction mix be physically removed, leaving some moisture present in the filter cake (on the zeolite particles or occluded therein) together with excess hydroxide therein. By filtering a portion of the mother liquor from the zeolite without preliminary washing such washing operation is avoided, some caustic is desirably conserved, the moisture content of the filter cake is kept low (the importance of which will be evident later), reaction capacity is increased (and higher caustic contents can be used in treating the aluminum silicate) and disposal problems are diminished. Also, perhaps due to the absence of a larger proportion of water (and due to the presence of the zeolite) the neutralization reaction proceeds satisfactorily without objectionable decompositions of the zeolite and the detergent sulfonate being made. Additionally, when the zeolite is in dilatant gel form (sometimes some of it could be in such form) addition of the sulfonic acid converts the dilatant gel to a more readily processable thixotropic form. However, usually the zeolite-detergent-water product of the invented process is homogeneous, stable even after months of storage and pumpable at slightly elevated temperature (38° C. or higher, e.g., 38°–50° C.).

The zeolite filter cake will normally contain from about 30 to 55% of zeolite solids (50% is a practical limit except when heat is employed to evaporate additional moisture), 1 to 8% of sodium hydroxide solids and the balance, 37 to 69% of water. Preferably such ranges are 40 to 50%, 5 to 7% and 43 to 55%, respectively. The caustic is dissolved in the liquid water present on the surfaces of the zeolite particles or occluded therein. Of course, a portion of the water may be in the zeolite hydrate crystals, e.g., about 20% of the zeolite crystal weight. The sodium hydroxide concentration in the mother liquor remaining with the zeolite in the filter cake or other zeolite-caustic mix from which a substantial proportion, such as over 50%, preferably over 70% and more preferably over 80% of mother liquor has been removed, is in the range of about 3 to 15%, e.g., 9 to 13%, and often is from 10 to 11%.

The high concentration aqueous alkylbenzene sulfonic detergent acid employed is one containing a minor proportion of water and very little free oil, preferably being essentially the described sulfonic acid, e.g., over 90% thereof. However, commercially it is very difficult to manufacture an essentially pure sulfonic acid without some sulfuric acid also being present, usually due to reaction of sulfur trioxide, from gas, liquid or oleum form, with water. Thus, the concentration of the sulfonic acid will be within the range of 70 to 99%, preferably 87 to 97%. Usually such lower concentrations are those resulting from the preparation of the alkylbenzene sulfonic acid by reaction of alkylbenzene with oleum but may result from addition of sulfuric acid to the sulfonic acid, as when the production of higher ratios of zeolite to detergent are desirable. The sulfuric acid content of the aqueous sulfonic acid mixture will usually be in the range of 5 to 10%, e.g., 7 to 9%, for sulfonic acids of the type described made from oleum or gaseous sulfur trioxide but such contents may be as high as 25% when oleum is employed in the manufacture of the sulfonic acid or when spent sulfonating acid is mixed in with the "oxide" sulfuric acid. Moisture contents of the high concentration alkylbenzene sulfonic detergent acids are normally in the range of 0.2 to 5%, preferably being about 1 to 4%, but may be as high as 10%, preferably no higher than 7%, when oleum has been employed in the sulfonic acid manufacture. Free oil contents, which oil may be absorbed by the zeolite during the processing of this invention, are normally in the range of 0.5 to 2%, such as 0.8 to 1.4%, e.g., about 1%. Although the free oil in some detergents tends to make them tacky and poorly flowing, sorption thereof by the zeolite and/or vaporization during spray drying tend to minimize such undesirable effects in the products of the present processes.

The alkylbenzene sulfonic acids utilized in the present invention are preferably linear alkylbenzene sulfonic acids wherein the alkyl is of 8 to 18 carbon atoms, preferably being of 10 to 14 atoms and more preferably of 11 to 13 or 14 carbon atoms. However, the present process is also applicable, although not necessarily to as desirable an extent and with such desirable results, when other alkylbenzene sulfonic acids are employed. Such other materials and the linear alkylbenzene sulfonic acids described may be used in mixture and may be employed separately or in mixture with other anionic detergent sulfonic acids and to some extent with corresponding detergent sulfuric acids.

The reaction effected between the excess sodium hydroxide with the zeolite filter cake and the alkylbenzene sulfonic acid may be conducted at room temperature or at reduced or elevated temperature, with or without the presence of heat transfer equipment designed to control the reaction temperature. Thus, such reaction may take place at temperatures in the range of 5° to 50° C. but preferably is initiated at about room temperature, e.g., 15°-30° C. It is preferred to have some type of temperature control to avoid undue raising of the temperature, such as above 60° C., during the exothermic reaction.

The proportions of reactants employed, based on the zeolite in the filter cake (anhydrous basis) will normally be within the range of 0.3 to 1.3 parts by weight of pure sulfonic acid (excluding any sulfuric acid present) to 1 part of zeolite, with such range preferably being from 0.6 to 1.0, for neutralization of the alkali metal hydroxide present in the filter cake with the zeolite. However, such proportions may be varied when the quantity of sodium hydroxide in the filter cake is known and the amount of acid to be employed may be measured accordingly. If desired, one may take into account the proportion of sulfuric acid present, when known, and in particular reactions, due to its greater neutralizing effect, may use more or less of the sulfonic-sulfuric acid mixture, depending on the particular acid contents thereof. A simple way of effecting the desired neutralization is by reaction of the sulfonic acid and caustic on the zeolite cake until desired pH is reached. By measuring the quantity of sulfonic acid added, and by knowing the proportion of sulfuric acid present with it, it will be known how much sulfonate and sulfate have been produced and if such quantities are less than the desired final formula quantities thereof additional sulfate and sulfonate may be added. Instead of separately making such sulfonate and incorporating it in the final composition the reaction medium containing the zeolite and detergent sulfonate may have additional sodium hydroxide and sulfonic acid admixed therein. Such additions can be carried out while maintaining the pH of the mixture in the desired range by additions at the same time of sodium hydroxide and sulfonic acid or one or the other of such reactants can be added initially, followed by the other. For example, excess sulfonic acid may be reacted with the sodium hydroxide in the zeolite so that the pH of the mix (or mother liquor) is below 9 but at a pH at which the zeolite is still stable and additional sodium hydroxide may be reacted with the excess sulfonic acid to bring the pH into the desired range. Alternatively, excess caustic may be added, preferably as a solid or 50% solution, to the zeolite filter cake before neutralization with the sulfonic acid. Also stepwise or simultaneous additions of the sulfonic acid and caustic may be made to adjust the detergent content of the mix and its pH. When additional detergent salt is to be manufactured in conjunction with the neutralization of the caustic on the zeolite it is preferable that the additions of detergent acid and alkaline material be step-wise so that the pH does not vary too far from the desired range. Such step-wise reactions help to stabilize the product and avoid acidic and basic extremes which might promote decomposition of the zeolite and/or detergent. The admixing of the materials being reacted may be of any of various types, including co-mixing as both are added to the reaction vessel, but it is preferred to add the high concentration alkylbenzene sulfonic detergent acid to the zeolite. By such addition the reaction mix may more readily be maintained in fluid and homogeneous form, avoiding overconcentrations and hot spots therein and the product will be of better color and acidic attack on equipment materials of construction will be lessened. However, it is also within the invention to add the zeolite to the acid, providing that good mixing is effected so that adverse reactions do not result. In all cases it is preferred to utilize a heel of neutralized mix (or water, initially), usually being 20 to 40%, e.g., ⅓, of the reaction vessel volume, with the balance being composed of the filter cake and acid.

After completion of neutralization to the desired pH of the mixture, 7 to 11, preferably 10 to 11, the product resulting will often contain from 25 to 40% of the Zeolite A (anhydrous basis), 16 to 40% of sodium linear higher alkylbenzene sulfonate, 2 to 10% of sodium sulfate and the balance, 10 to 57%, of water. At high solids the figures can be 25 to 34%, 16 to 34%, 3 to 5% and 27 to 56%, respectively, e.g., 31%, 31%, 4% and 34%, respectively.

The reaction described proceeds without difficulty and the product resulting is readily pumpable so that it can be easily transported to a crutcher or, if desired, the mixing vessel may itself be used as a crutcher and the product may be pumped from it to the spray nozzles, when spray drying is to be effected. Alternatively, it may be readily transported to other mixing and drying apparatuses. On the contrary, Zeolite A filter cake is not so readily transportable and usually, because of its dilatant characteristics, if it is added to the crutcher, as is, causes low spray tower feed concentrations and resulting lower spray tower capacity, together with higher energy requirements and often results in a finished product of unacceptably low density. The present "intermediate" detergent-zeolite product results in excellent spray drying characteristics, equivalent to those when a Zeolite A powder containing 22% moisture of hydration is employed with a 52% solids detergent base, and such improved processing characteristics result without the need to dry the zeolite. Thus, the time and energy otherwise consumed in effecting such drying are also conserved.

The operativeness of the present invention is somewhat surprising in view of the employment of high concentration or strong sulfonic acid for neutralization of the caustic on the zeolite cake. It should be noted that strong sulfuric acid, when employed to neutralize such caustic, destroys the zeolite. Carbon dioxide neutralization is useful but is only for products where sodium carbonate content is desirable. Also, by employment of such neutralization one is not able economically to reduce the moisture content of the product sufficiently so that it may be employed as a component of crutcher mixes to be spray dried without requiring elimination of water from other such components to obtain good drying and product characteristics. The use of strong sulfonic acid for neutralization of the reaction mixture also does not result in a product as low in moisture as that of the present invention. However, despite the lack of success with such other processes, the employment of strong sulfonic acid of the type described herein produces a good zeolite and sufficiently lowers the moisture content of the product so as to allow spray drying thereof to a desired zeolite-synthetic detergent product of commercially acceptable characteristics. Among the main advantages of the present processes, as was mentioned previously, is that they are highly adaptable to use in the manufacture of various detergent composition formulations and are highly energy efficient, eliminating various concentration and drying steps and eliminating normal washing of the zeolite after manufacture. With all these advantages the product made is superior to many other zeolite formulas in not depositing zeolite or other chalky powder material on fabrics and laundry washed with it.

The products of the present invention, containing zeolite, sulfonate detergent, sulfate filler salt and water (free oil is often considered to be part of the moisture content in this art) may be dried directly by any of various drying techniques, of which spray drying is highly preferred, or may be mixed with other components of a desired synthetic organic detergent composition and such mixture may be dried, again preferably by spray drying. In either case a useful built detergent is made. However, when the product of the neutralization process is dried directly, without compounding with other detergent composition components, rather than utilizing it commercially as a built laundry detergent it will often be compounded subsequently with other additives, such as perfumes, fluorescent brighteners, inorganic and organic builders, fillers and supplementary detergents, to make a final heavy duty laundry detergent composition. In such compositions there will normally be present from 5 to 80%, preferably 10 to 60%, e.g., 20 to 40% on a final product basis (as is), of salt(s) selected from the group consisting of inorganic filler salts, inorganic builder salts and mixtures thereof. Among the inorganic filler salts that may be useful are sodium sulfate and sodium chloride, the former of which is a byproduct of the neutralization reaction of this invention. With respect to builder salts the most preferred are sodium silicate, sodium carbonate, sodium bicarbonate, pentasodium tripolyphosphate, tetrasodium pyrophosphate and borax, although other builders and other alkali metal salts, e.g., potassium salts, of such materials may be employed. Additionally, one may sometimes wish to add from 1 to 20%, e.g., 4 to 10%, of other synthetic anionic organic detergent, such as sodium lauryl sulfate, sodium cetyl alcohol polyethoxy (10) sulfate, olefin sulfonates, paraffin sulfonates, higher alkyl phenoxy polyethoxy sulfates wherein the ethoxy chain is from 5 to 15 ethoxy groups long, monoglyceride sulfates and hydrotropes, such as sodium toluene sulfonate. The corresponding alkanolamine, e.g., triethanolamine, and alkali metal, e.g., sodium and potassium, salts may also be employed, as may be these and other such compounds wherein the alkyl or other aliphatic group is from 10 to 18 carbons, preferably 12 to 16 carbons long. A small proportion, such as 0.5 to 3%, preferably about 2% of nonionic detergent, preferably higher fatty alcohol polyethylene oxide condensate (sold by Shell Chemical Co, as Neodol®45-11), may also be incorporated in the mix to be spray dried and a larger proportion, e.g., 2 to 10%, may be post-added. Additionally, there may be employed small proportions of various other adjuvants, usually from 0.1 to 5%, with the total thereof normally being less than 10%. Such adjuvants include anti-redeposition agents, e.g., sodium carboxymethylcellulose, perfumes, colorants, including dyes and pigments, fluorescent brighteners, bleaches, activators for the bleaches, enzymes, plasticizers and denatured proteins, useful to improve the mildness of aqueous solutions of the detergents to the human hands. Generally, such materials that are heat sensitive will be post-added to the dried particulate detergent composition.

When the products of the neutralization are spray dried directly, usually in countercurrent spray towers utilizing heated gas (air) at a temperature of 200° to 400° C. as the drying air, the product made will normally be in spherical shape and of a moisture content under 20%, normally in the range of 6 to 16%, preferably 7 to 13% and often about 8 to 10%. A similar moisture content is obtainable when the crutcher mix containing the neutralization reaction products and other detergent composition components is spray dried. Particle sizes of the product will normally be in the range of 8 to 140 mesh, preferably 10 to 100 mesh (U.S. Sieve Series) and to obtain such size ranges sometimes fines and coarse particles will be removed by screening or other applicable size classification method. The SLTBS content will normally be 5 to 25 or 30%, preferably from 8 to 20%, e.g., 14%, and the zeolite concentration will be from 10 to 50%, preferably 20 to 30%, e.g., 25%.

The products obtained are of desirable free flowing characteristics, stable on storage, wash clothes well and do not objectionably whiten dark fabrics, as by deposit of zeolite or calcium carbonate thereon, after washing in hard water.

The following examples illustrate but do not limit this invention. Unless otherwise indicated all temperatures in the examples and in the specification are in °C. and all parts are by weight.

EXAMPLE 1

A Zeolite A type of gel, containing excess sodium hydroxide, is made by reacting sodium hydroxide, alumina trihydrate, sodium silicate and water. Initially 995.2 parts of a 50% sodium hydroxide solution (containing 447.6 parts of NaOH) are mixed with sufficient water to make an aqueous sodium hydroxide solution containing 18% NaOH. 589.5 Parts of alumina trihydrate (containing 380.6 parts of $Al_2O_3$) are mixed with such sodium hydroxide solution in a pressure vessel by slow addition of the alumina trihydrate to the aqueous sodium hydroxide, after which the vessel is sealed, the pressure is raised to 4 kg./sq. cm. and the temperature is raised to 149° C., with mixing continuing. After ½ hour the sodium aluminate product resulting is cooled to 49° C. To a separate vessel, a larger capacity crutcher equipped with an agitator and containing 1872.1 parts of water and 222.7 parts of NaOH, an aqueous solution of sodium silicate, containing 391.8 parts $SiO_2$, 211.2 parts of NaOH and 582.5 parts of water, is charged, the temperature is raised to 49° C. and the sodium silicate solution is recycled through a homogenizer. Then, the aqueous sodium aluminate reaction mixture is slowly added thereto over a 15 minute period, after the completion of which addition the temperature is raised to 93° C. by means of jacket steam. When the temperature has reached 93° C. open steam addition is utilized to raise the temperature to about 100° C., at which temperature the reaction mix is held an hour (with or without recycling and homogenizing) and also is filtered by means of a vacuum drum filter to produce a desired Zeolite A-sodium hydroxide-water mixture in filter cake form. The reaction mixture, as charged, includes 391.8 parts of $SiO_2$, 380.6 parts of $Al_2O_3$, 881.5 parts of NaOH and 4706.5 parts of water. The reaction product includes 1,000 parts Zeolite A (anhydrous basis), 584.8 parts of NaOH and 4775.5 parts of water. After filtration the unwashed filter cake contains 1,000 parts of Zeolite A, 139.4 parts of NaOH and 1139.4 parts of water, corresponding to 43.88% of Zeolite A, 6.12% of NaOH and 50% of water. The sodium hydroxide is in solution on the zeolite particle surfaces and occluded therein. The mother liquor removed, which may be recycled, as by addition to the caustic to be used for manufacture of the sodium aluminate and also by addition in the gel making step (normally about ½ of the mother liquor being recycled to each such step), includes 455.4 parts of NaOH and 3636.1 parts of water, corresponding to 10.9% of NaOH and 89.1% of water.

In a separate neutralizer vessel 1,111 parts of "crude" linear tridecylbenzene sulfonic detergent acid, containing with it 8.4 parts of sulfuric acid, 3.6 parts of water and one part of oil per 87 parts of sulfonic acid, are employed to neutralize the excess sodium hydroxide in the zeolite by addition to 1,000 parts of the zeolite (anhydrous basis) with the excess hydroxide present with it. Using the proportions recited the hydroxide is neutralized, the mixture resulting has a pH of 10, the detergent salt is produced (with some sodium sulfate) and the zeolite isn't degraded. The heat of reaction, e.g. at 60° C., causes a loss of moisture. The resulting mixture, including 31% of Zeolite A (anhydrous), 31% of sodium alkylbenzene sulfonate, 4% of sodium sulfate and 34% of water, may be pumped and may be stored until needed. However it is often spray dried, using a conventional countercurrent spray drying tower with inlet air at 300° C., and produces spherical beads in the 8 to 140 mesh (U.S. Sieve Series) range. The product is useful directly as a heavy duty synthetic organic detergent composition or it may be compounded with other detergent composition adjuvants to produce other built detergent products.

When laundry is washed with the described preparation in an automatic washing (normal wash cycle) machine charged with 3.5 kilograms of laundry per 65 liters of wash water containing 100 parts per million of hardness ions, as calcium carbonate, at a washing temperature of 65° C. and at a concentration of 0.15% of the detergent composition in the wash water, and the laundry washed in either line dried or dried in an automatic laundry dryer, it is found to be washed clean and does not exhibit objectionable whitening of dark colored fabrics washed due to any residue being deposited thereon. The dried detergent "intermediate" product, at a moisture content of about 9%, is free flowing and stable on storage. It is also useful for compounding with other detergent composition constituents, such as with 0.5% of sodium carboxymethyl cellulose, 20% of sodium sulfate, 20% of pentasodium tripolyphosphate, 1% of a fluorescent brightener mixture, 0.3% of perfume and 5% of Neodol 45-11 (a polyethoxylated higher fatty alcohol wherein the alcohol is of about 14.5 carbon atoms [average] and which contains about 11 mols of ethylene oxide per mol). The perfume and Neodol 45-11, a liquid, are post-sprayed onto the mixed particles. Such product is even better than the "dried intermediate" for use as a built heavy duty detergent composition and it exhibits the same desirable properties as the "intermediate" previously described. Its moisture content is about 7%, compared to the 9% moisture in the spray dried "intermediate".

In further experiments utilizing the same undried intermediate Zeolite A-linear higher alkylbenzene sulfonate mix with water (and sodium sulfate) the mix is crutched with sodium silicate, pentasodium tripolyphosphate, sodium sulfate, sodium carboxymethylcellulose and fluorescent brightener mixture to produce a product like that previously described and obtainable by dry mixing of the components, after which the perfume and nonionic detergent (Neodol 45-11) are sprayed thereon, as before. The product resulting, having a moisture content of 9%, possesses all the advantages of the dry mixed material and additionally is more uniform in appearance and is of improved non-segregating (by settling) properties. In comparative experiments when it is attempted to spray dry to the same final product formula using the reaction mixture from Zeolite A manufacture, the filter cake from said manufacture or the washed filter cake from said manufacture, with a detergent base made from sulfonic acid and caustic (12–18% concentration) so that the final detergent slurry concentration is about 50–52% solids, the product made is unacceptably heavy and tower throughput is diminished. However, when powdered Zeolite A (22% moisture of hydration) and 52% detergent base are employed to make the same product, essentially the same characteristics are obtainable as in products made from intermediates produced by the invented method.

From the present example and from the other examples which follow it is seen that the present invention is advantageous over prior art methods (and products) because: (1) laundry residues are diminished (despite the fact that the particle sizes of the zeolite are essentially the same as those which normally result in residue); (2) less energy is consumed because of the reduced amount of moisture to be removed (thus throughput may be increased, fuel may be saved, smaller size equipment may be utilized and operating costs may be lowered); (3) the storage of Zeolite A, normally difficult because of its dilatant properties, is practicable at high solids contents (when with the alkylbenzene sulfonate, as made by the process of this invention); and (4) the viscosity of the Zeolite A slurry (containing alkylbenzene sulfonate) is lowered and pumping thereof is much more readily effected, saving time and energy.

In a variation of this example Zeolite X is made by the method described herein for the manufacture of Zeolite A with the exception that the proportions of reactants are modified so as to produce a Type X zeolite in the corresponding aqueous reaction medium. Such mixture is filtered in the manner previously described and is neutralized with sodium hydroxide solution to produce a Zeolite X-linear alkylbenzene sulfonate mix, which is subsequently spray dried under the conditions previously set forth. The spray dried zeolite-alkylbenzene sulfonate mixtures (A and X) are then mixed together to produce a product having desirble detersive and combined building effects. Similarly, both the Zeolite A-alkylbenzene sulfonate and Zeolite X-alkylbenzene sulfonate mixtures are crutched with the other detergent composition components mentioned herein and the spray dried beads resulting are blended together to form a finished detergent composition in which the desirable properties of both the Zeolite A and Zeolite X are exhibited. Instead of separately spray drying the Zeolite A- and Zeolite X-detergent compositions both the Zeolite A-alkylbenzene sulfonate and Zeolite X-alkylbenzene sulfonate mixtures, usually in proportions in the range of 1:0.2 to 1:2, are pre-blended in the crutcher with the other detergent composition components and are spray dried together. Of course, liquid components of the final product, as previously mentioned, may be post-sprayed onto or otherwise mixed with the spray dried beads.

In further modifications of this example the Zeolite A and Zeolite X, separately manufactured, are mixed together, either as reaction mixtures or as filtered cakes and are processed by the method of this invention to either mixed detergent intermediates or final detergent compositions. If reaction mixtures of the Zeolite A and X are mixed together they are first filtered and then reacted with the described linear alkylbenzene sulfonic acid. If the filter cakes are utilized no special mixing is necessary. However, in both cases it is preferred to utilize the described heel of product so as to "temper" the neutralization reaction. Of course, the resulting neutralized mix may be dried and employed as an intermediate for compounding with other detergent components or may be mixed with other components and subsequently dried, as by spray drying.

Instead of using Zeolite X, Zeolite Y and/or other detergent builder zeolites capable of "tying up" hardness ions may be substituted and various zeolite-detergent mixtures may be produced by the method of this invention.

EXAMPLE 2

Utilizing the filter cake of Zeolite A, sodium hydroxide and water produced by the method described in Example 1 a variety of ratios of Zeolite A:sodium linear tridecylbenzene sulfonate (SLTBS) are obtainable so that the products of the present invention may either be spray dried to a final product of the desired zeolite:sulfonate detergent proportion or may be incorporated in a detergent composition in which the zeolite and detergent sulfonate will be present in the desired proportion. Among the proportions of Zeolite A to sodium linear tridecylbenzene sulfonate that are made are 1.0; 1.33; 1.58; 2.14; 2.5 and 3.0, which correspond respectively to the following percentages of Zeolite A and the detergent in a final detergent composition: 20 and 20; 20 and 15; 30 and 19; 30 and 14; 20 and 8; 30 and 10. Such products are produced by utilizing a Zeolite A filter cake having 43.88% of Zeolite A (anhydrous basis), 6.12% of NaOH and 50% of $H_2O$, and an upper layer linear tridecylbenzene sulfonic acid from the oleum process for the manufacture of such sulfonic acid by sulfonation of the corresponding alkane with oleum, which upper layer linear tridecylbenzene sulfonic acid includes 87.5% of such acid, 9.8% of $H_2SO_4$, 1.7% of $H_2O$ and 1% of free oil. The neutralization reaction may be conducted at room temperature or at an elevated temperature, e.g., 60° C., and solids content of the product can be controlled by temperature regulation. To make a product of Zeolite A:SLTBS ratio of 1, one reacts 100 parts of the described upper layer acid mix with 212.4 parts of Zeolite A filter cake. The product resulting is of 62.4% solids content, including the Zeolite A (anhydrous), sodium linear tridecylbenzene sulfonate and sodium sulfate. In such a product the ratio of sulfate to Zeolite A (anhydrous) is 0.152 and 10.7% of 50% NaOH will be utilized in the reaction mix in addition to that present with the zeolite filter cake. The final product will contain 28.8% of sodium linear tridecylbenzene sulfonate, 28.8% of Zeolite A (anhydrous basis), 4.4% of sodium sulfate, 0.3% of free oil and 37.7% of water.

The neutralization method utilized may include initial addition of the supplementing sodium hydroxide to the Zeolite A filter cake, followed by admixing of the upper layer acid with such mixture but step-wise additions of acid may be practiced, with the supplementing hydroxide solution usually being added near the end of the neutralization process. When the Zeolite A:detergent sulfonate ratio is increased, such as to 3, 637.2 parts of the described filter cake will have the sodium hydroxide content thereof neutralized by 100 parts of upper layer acid mix and because of the larger quantity of sodium hydroxide present with the increased proportion of filter cake, 33.7 parts of spent acid (75% $H_2SO_4$) will be utilized, either with the upper layer acid mix or during a step-wise neutralization process. The product made will contain 55.1% of solids and the ratio of sodium sulfate to Zeolite A (anhydrous) will be 0.182. It is found that despite the use of additional sulfuric acid by the practice of this method the Zeolite A is not degraded and its sequestering and building properties are not significantly adversely affected. However, when a Zeolite A filter cake containing 7% or more of sodium hydroxide (and 43% of less of Zeolite A, anhydrous and 50% of water) is used as a starting material the quantity of spent acid needed, 44.4 parts, causes an objectionable reduction in the sequestering power of the Zeolite A. Generally, it has been found that the proportion of spent acid to upper layer linear tridecylbenzene sulfonic acid should be kept less than 40%, preferably less than 35%. These figures correspond to the spent acid being less than 28% and preferably less than 26% of the total acid. On the basis of sulfuric acid content the percentage of sulfuric acid should be less than 25% of the total of sulfuric acid and sulfonic acid and preferably is less than 22% thereof. For example, such sulfuric acid content may be from 0 to 25% and preferably is from 2 to 22%.

The foregoing experiments may also be run utilizing linear tridecylbenzene sulfonic acid made from sulfur trioxide sulfonation of linear tridecylbenzene. Similarly, other zeolites, such as Zeolite X and other detergent acids, such as linear dodecylbenzene sulfonic acid, mixtures of $C_{11-14}$ linear alkylbenzene sulfonic acids, $C_{12-18}$ paraffin sulfonic acid mixes, $C_{14-16}$ olefin sulfonic acid mixes and other suitable detergent sulfonic and sulfuric acids may be employed, preferably in mixture with a linear alkylbenzene sulfonic acid. Specifically, mixes of Zeolites A and X, e.g., 50-50 mixes, can be made, either before or after filtration(s) and can be treated with the described detergent acid(s) to produce zeolite plus detergent mixtures.

The products described in this example are convertible to finished detergent compositions by spray drying, as described in Example 1. The resulting products thereof possess the advantages described for corresponding compositions of Example 1.

EXAMPLE 3

To manufacture an aqueous mixture of Zeolite A and sodium linear tridecylbenzene sulfonate suitable for use in compositions requiring 20 parts of Zeolite A and 8 parts of the sulfonate detergent (a 2.5:1 ratio) there are reacted 100 parts of the described upper layer acid mix with 531 parts of Zeolite A filter cake of the composition previously described (43.88% Zeolite A, anhydrous; 6.12% NaOH; and 50% $H_2O$). It is seen that the filter cake contains 32.5 parts of NaOH, of which 18.4 parts will be neutralized by the upper layer acid, leaving 14.1 parts to be neutralized with 23.1 parts of spent acid. 14.2 Parts of sodium sulfate will be produced from the upper layer sulfuric acid and 25.1 parts of the sulfate will result from the spent acid, making a total of 39.3 parts of sodium sulfate in the product. The product contains 14.2% of sodium linear tridecylbenzene sulfonate, 35.6% of Zeolite A, 6.0% of sodium sulfate, 0.2% of free oil and 44% of water.

In other experiments, all based on a standard 50% moisture content Zeolite A filter cake, various ratios of zeolite to sodium hydroxide, ranging from 40 to 49% of Zeolite A to 10 to 1% of sodium hydroxide, are employed and Zeolite A:sodium linear tridecylbenzene sulfonate ratios over the range of 1 to 3 are obtained. Because it is desirable for the promotion of the reaction for the production of Zeolite A that an excess of sodium hydroxide be present and that the sodium hydroxide solution in the reaction mix be fairly concentrated, e.g., 12-16%, which also avoids the need for concentration of mother liquor used for recycle, to obtain higher ratios of Zeolite A to the detergent in the product it is often preferable to wash the Zeolite A reaction mix, at least slightly, before filtration so as to reduce the excess of sodium hydroxide present which would have to be neutralized by detergent sulfonic acid.

The above reaction and those of the other examples given may also be varied by utilizing filter cakes of moisture contents other than 50%, e.g., 40 to 55%, with corresponding variations in the proportions of materials employed.

Of course, various modifications may be made in the conditions recited in the above examples. For example, while the reaction of the alkylbenzene sulfonic acid with the alkali metal hydroxide may be initiated at about room temperature, often the heat of reaction will raise this temperature to the range of 40° to 70° C., preferably about 50° to 60° C., and the reaction mix may be held at such temperature for a suitable period of time to evaporate additional moisture from the mix, if desired. Normally the upper limit on the solids content of such a reaction mix will be about 60 or 62% but can be raised to 65 or 66% by evaporation of such moisture. Of course, moisture evaporation may also be effected in the manufacture of the zeolite and again the heat of reaction may be employed. Alternatively, external heating may be utilized in both cases to promote production of a higher solids content products.

Although in the previous examples the manufacture of zeolite by the hydrogel process was recited the present reactions are equally well applicable to clay conversion processes, such as those wherein kaolin or alpha-kaolin are converted to zeolites. In Europe the sulfonating medium of choice is normally sulfur trioxide but in America it is usually oleum. Thus, the present examples recite the use of oleum-derived upper layer sulfonic acid but the reaction is also effected with linear alkylbenzene sulfonic acid derived from sulfur trioxide sulfonation of the linear alkylbenzene. For example, such a sulfonic acid may contain 93-99% of "pure" linear tridecylbenzene sulfonic acid, e.g., 96%, and the products resulting will be satisfactory (and will be lower in sodium sulfate content). In neutralizing the zeolite with the detergent acid the pH is lowered from over 13 to the mentioned 7 to 11 range, preferably about 10.5. Also, in the above experiments, when mixed zeolites are desired, it they can be made together compatibly the zeolites can be manufactured together, filtered and neutralized together with the detergent acid.

Although it is an important aspect of the present invention, as described in the above specification and working examples, to utilize the zeolite reaction mixture without washing, sometimes it may be desirable to wash to some extent, as was mentioned previously, whereby the adjustment of the ratio of detergent to zeolite may be effected. Furthermore, as when the zeolite employed is made from clay, wherein there may be a color problem if the zeolite and caustic are used directly, without washing the zeolite, the zeolite may be washed to remove the caustic and such color, after which fresh caustic of good color may be added back to the zeolite mix and such may be filtered, if desired, so as to obtain a high solids content zeolite-alkali metal hydroxide mixture for neutralization with detergent acid. Thus, processes of the preceding examples may be so modified so as to produce a detergent-zeolite mix of good color despite the fact that the zeolite is manufactured from a clay which normally adds color to the product, thereby making it unsuitable for various applications. The filtration or dewatering which may be effected both after such washing and after caustic addition is preferably carried out in the same manner as was previously described. The temperature employed for this and other such filtrations will usually be in the range of 80° to 95° C. so as to maintain the fluidity of the mix for filtration. Filtration can be conducted at lower temperatures, even down to 40° C., but mix viscosities and consequent pressure drops increase when the temperature is lowered.

In addition to washing being desirable in treatment of products made frm clay it is also useful when it is desired to have different alkali metals or other cations in the zeolite and the detergent. Thus, a sodium detergent made be manufactured despite the fact that the zeolite is one based on $K_2O$, by removing the potassium hydroxide from the zeolite, adding sodium hydroxide back to it and conducting the neutralization as described in the foregoing examples. Thus, although a very important feature of the present invention is in conserving the alkali metal hydroxide which is a byproduct of the manufacture of the zeolite, and of utilizing it for detergent neutralization to produce a high solids content zeolite-detergent mix, in a broader sense such as high solids content mix can be made, utilizing the moisture inevitably present with the zeolite and difficulty removable from it, to replace moisture which would otherwise be added in the manufacture of neutralized detergent, thereby limiting the moisture content of the desired zeolite-detergent mixture. Thus, it is important in the preceding examples, to limit moisture content of the zeolite-hydroxide mix being neutralized, and this should be less than 70% of water, e.g., 40 to 70%.

The "intermediate" water containing products of the examples previously given and the modifications thereof mentioned herein are stable on storage and yet are readily pumpable when the temperature thereof is raised slightly, such as to 38° C. or over. Analysis of such a product stored at room temperature for a month showed that it had not deteriorated. Although when stored the mix thickens (and resembles a typical detergent composition crutcher mix) it is readily made pumpable by heating and requires no special mixing or pumping equipment. Such improved characteristic of the product facilitates its use and the practicing of the present invented processes in commercial detergent manufacture plants.

In the above experiments the proportions of the various reactants may be varied ±10%, ±20% and ±30% within the ranges described in the foregoing specification and the desired results will still be obtainable. Similarly, reaction conditions, order of additions and supplementing materials may be varied as taught in the foregoing specification without losing the advantages of this invention.

The invention has been described with respect to various illustrations of preferred embodiments thereof but is not to be limited to these because it is evident that one of skill in the art with the present specification before him will be able to utilize substitutes and equivalents without departing from the invention.

What is claimed is:

1. A process for making a high solids content crystalline zeolite Type A or amorphous aluminosilicate zeolite-alkylbenzene sulfonate composition suitable for use in making spray dried detergent compositions, which comprises:

manufacturing said zeolite in an aqueous medium containing sodium hydroxide in solution therein;

separating a substantial proportion of the aqueous medium from said zeolite so as to produce zeolite particles containing excess sodium hydroxide solution on the particle surfaces, said zeolite particles having an ultimate particle size of from about 0.1 to 12 microns;

neutralizing said excess sodium hydroxide solution with aqueous linear higher alkylbenzene sulfonic acid in excess of the amount needed to neutralize said sodium hydroxide on the zeolite particle surfaces and occluded therein; and adding a second portion of sodium hydroxide in an amount sufficient to neutralize said excess amount of linear higher alkylbenzene sulfonic acid and produce additional sodium linear alkylbenzene sulfonate in the resulting composition.

2. The process according to claim 1 wherein the proportion of sulfonic acid to Zeolite A on an anhydrous zeolite A basis, and on a pure sulfonic acid basis is from about 0.3 to 1.3; and wherein the high solids content zeolite A-alkylbenzene sulfonate composition made contains about 25 to 34% of zeolite A on an anhydrous basis, about 16 to about 34% of alkylbenzene sulfonate, and about 27 to about 56% water.

3. A process for making a high solids content crystalline or amorphous detergent building aluminosilicate zeolite-alkylbenzene sulfonate composition suitable for use in making spray dried detergent compositions, which comprises: manufacturing said zeolite in an aqueous medium containing alkali metal hydroxide in solution therein; separating a substantial proportion of the aqueous medium from said zeolite so as to produce zeolite particles containing excess alkali metal hydroxide solution on the particle surfaces, said zeolite particles having an ultimate particle size of from about 0.1 to about 12 microns; neutralizing said excess metal hydroxide solution with aqueous alkylbenzene sulfonic detergent acid having a concentration of from about 70 to about 99% and being present in an excess over the amount needed to neutralize said hydroxide solution; and adding a second portion of alkali metal hydroxide which is sufficient to neutralize said excess of alkylbenzene sulfonic detergent acid and provide alkylbenzene sulfonate.

4. A process for making a high solids content crystalline zeolite Type A or amorphous aluminosilicate zeolite-alkylbenzene sulfonate composition suitable for use in making spray dried detergent compositions, which comprises:

manufacturing said zeolite in an aqueous medium containing sodium hydroxide in solution therein;

separating by filtration a substantial proportion of the aqueous medium from said zeolite so as to produce zeolite particles in cake form, said particles containing excess sodium hydroxide solution on their surfaces and said particles having an ultimate particle size of from about 0.1 to 12 microns;

neutralizing said excess sodium hydroxide solution with aqueous linear higher alkylbenzene sulfonic acid having 11 to 14 carbon atoms in the linear alkyl chain, said aqueous acid having a concentration of from 70 to 99% pure sulfonic acid and said aqueous acid being in excess of the amount needed to neutralize said sodium hydroxide solution; and adding a second portion of sodium hydroxide in an amount sufficient to neutralize said excess amount of linear higher alkylbenzene sulfonic acid and produce additional sodium linear higher alkyl benzene sulfonate in the resulting composition; and wherein, the proportion of said linear higher alkylbenzene sulfonic acid to zeolite on an anhydrous zeolite and pure sulfonic acid basis is from 0.3 to 1.3.

5. A process according to claim 4 wherein said proportion of acid to zeolite is from 0.6 to 1.0, said zeolite in cake form contains 30 to 55% solids and said aqueous acid has a concentration of 87 to 97% pure alkylbenzene sulfonic acid.

* * * * *